US005555729A

United States Patent [19]

Momose et al.

[11] Patent Number: 5,555,729

[45] Date of Patent: Sep. 17, 1996

[54] STIRLING ENGINE

[75] Inventors: Yutaka Momose; Koji Fujiwara; Juniti Mita, all of Aichi, Japan

[73] Assignee: Aisin Seiki Kabushiki Kaisha, Kariya, Japan

[21] Appl. No.: 340,381

[22] Filed: Nov. 15, 1994

[30] Foreign Application Priority Data

Nov. 15, 1993 [JP] Japan ..... 5-284961

[51] Int. Cl.[6] ..... F28F 1/40; F02G 1/044

[52] U.S. Cl. ..... 60/517; 165/183; 165/DIG. 524; 165/DIG. 527

[58] Field of Search ..... 60/517; 165/179, 165/183, DIG. 524, DIG. 527

[56] References Cited

U.S. PATENT DOCUMENTS 4,195,482 4/1980 Moloney ..... 60/517
5,388,410 2/1995 Momose et al. ..... 60/517

FOREIGN PATENT DOCUMENTS 58-221390 12/1983 Japan ..... 165/179
63-45050 3/1988 Japan .
5133694 5/1993 Japan ..... 165/183

*Primary Examiner*—Leonard E. Heyman
*Attorney, Agent, or Firm*—Oblon, Spivak, McClelland, Maier, & Neustadt, P.C.

[57] ABSTRACT

In a Stirling engine comprising: a cylinder having an expansion space; a housing accommodating a heat accumulating unit; and a heating unit through which said expansion space is communicated with the heat accumulating unit, the heating unit is formed by using a flattened pipe, and preferably heat transferring fins, and reinforcing members for preventing the increase in volume of the flow path in the heating unit are provided in the latter, so that in connecting the heating unit to the cylinder and the housing, the number of assembling steps is decreased, and the heating unit is sufficiently large in dead volume ("flow path sectional area" x "flow path length") and in heat transfer area.

9 Claims, 3 Drawing Sheets

STIRLING ENGINE

BACKGROUND OF THE INVENTION

1. Field of the Invention

This invention relates to a Stirling engine having a heating unit which is formed by using pipes.

2. Discussion of the Related Art

A Stirling engine of this type has been disclosed by Japanese Utility Model Unexamined Publication No. Sho 63-45050. The conventional Stirling engine comprises: a cylinder having an expansion space; a housing accommodating a heat accumulating unit, and a heating unit through which the expansion space is communicated with the heat accumulating unit. The heating unit is formed by using a number of heater tubes circular in section. The operating fluid in the heater tubes is heated by a combustion device (not shown).

As described above, the heating unit is formed by using a plurality of heater tubes. Hence, it takes a number of assembling steps to connect those heater tubes to the cylinder and the housing. The number of assembling steps may be decreased by employing one heater tube instead of the plurality of heater tubes in such a manner that the product of the sectional area of the flow path in the one heater tube and the length of the heating unit (hereinafter referred to as "a dead volume") is equal to the sum of the dead volumes of the plurality of heater tubes. However, in this case, the surface area of the one heater tube is much smaller than the sum of the surface areas of the plurality of heater tubes. That is, the heating unit formed by using one heater tube, is insufficient in heat transfer area, so that the amount of heat transferred to the inside of the heater tube from the combustion device is small.

SUMMARY OF THE INVENTION

In view of the foregoing, an object of the invention is to provide a Stirling engine in which, in connecting the heating unit to the cylinder and the housing, the number of assembling steps is reduced, and the heating unit is sufficiently large in dead volume and in heat transfer area.

The foregoing objects of the invention have been achieved by the provision of a Stirling engine which comprises: a cylinder having an expansion space; a housing accommodating a heat accumulating unit; and a heating unit through which the expansion space is communicated with the heat accumulating unit, in which the heating unit is formed by using a flattened pipe.

In the Stirling engine thus constituted, the heating unit is formed by using one pipe. Hence, the Stirling engine of the invention, when compared with the conventional one whose heating unit is formed by using a number of heater tubes, is small in the number of assembling steps in connecting the heating unit to the cylinder having the expansion space and the housing accommodating the heat accumulating unit.

in addition, the heating unit is formed by using a flattened pipe. Hence, under the condition that the flattened pipe is equal in dead volume ("flow path sectional area" x "flow path length") to the heater tube circular in section, the flattened pipe is larger in surface area than the heater tube, and the former is larger in heat transfer area than the latter, so that the former is larger in the amount of heat transferred to the inside of the heating unit from outside than the latter. When the pipe is further flattened, then the resultant heating unit may have substantially the same amount of heat transfer as the one which is formed by using a number of heater tubes circular in section.

Also, in the Stirling engine according to the invention, heat transferring fins are provided in the heating unit.

In the Stirling engine thus constituted, the heat transferring fins inside the heating unit further increases the heat transfer area and accordingly the amount of heat transfer.

Further, according to the Stirling engine of the invention, reinforcing members are provided in the heating unit to prevent the flow path in the heating unit from increasing in volume.

In the Stirling engine thus constituted, the reinforcing members eliminate the difficulty that, when the operating fluid in the heating unit is expanded by heating, the heating unit is inflated and broken. This contributes to an improvement of the durability of the heating unit.

Still further, according to the Stirling engine of the invention, the heating unit is integral with the cylinder.

Hence, the Stirling engine thus constituted is free from the problem that the heating unit is not sealingly connected to the cylinder, and from the assembling work of connecting the heating unit to the cylinder.

Still further, according to the Stirling engine of the invention, the expansion-space-side end portion of the cylinder is formed into a flat portion, and the expansion-space-side end portion of the heating unit is fixedly secured to the cylinder being held by the flat portion, Hence, in the Stirling engine thus constituted, the heating unit may be smaller in wall thickness and accordingly larger in the amount of heat transfer than the one which is integral with the cylinder.

Still further, according to the Stirling engine of the invention, the heating unit is integral with the housing.

Hence, the Stirling engine thus constituted is free from the problem that the heating unit is not sealingly connected to the housing, and from the assembling work of connecting the heating unit to the housing.

According to the Stirling engine of the invention, the heating-unit-side end portion of the housing is formed into a flat portion, and the heat-accumulating-unit-side end portion of the heating unit is fixedly secured to the housing being held by the flat portion of the housing.

Hence, in the Stirling engine thus constituted, the heating unit may be smaller in wall thickness and accordingly larger in the amount of heat transfer than the one which is integral with the cylinder. The nature, utility and principle of the invention will be more clearly understood from the following detailed description and the appended claims when read in conjunction with the accompanying drawings.

BRIEF DESCRIPTION OF THE DRAWING(S)

DETAILED DESCRIPTION OF THE PREFERRED EMBODIMENTS

Preferred embodiments of the invention will be described with reference to the accompanying drawings.

First, a double acting type Stirling engine (one cylinder), which constitutes a first embodiment of the invention, will be described with reference to FIG. 1.

Figure 1:
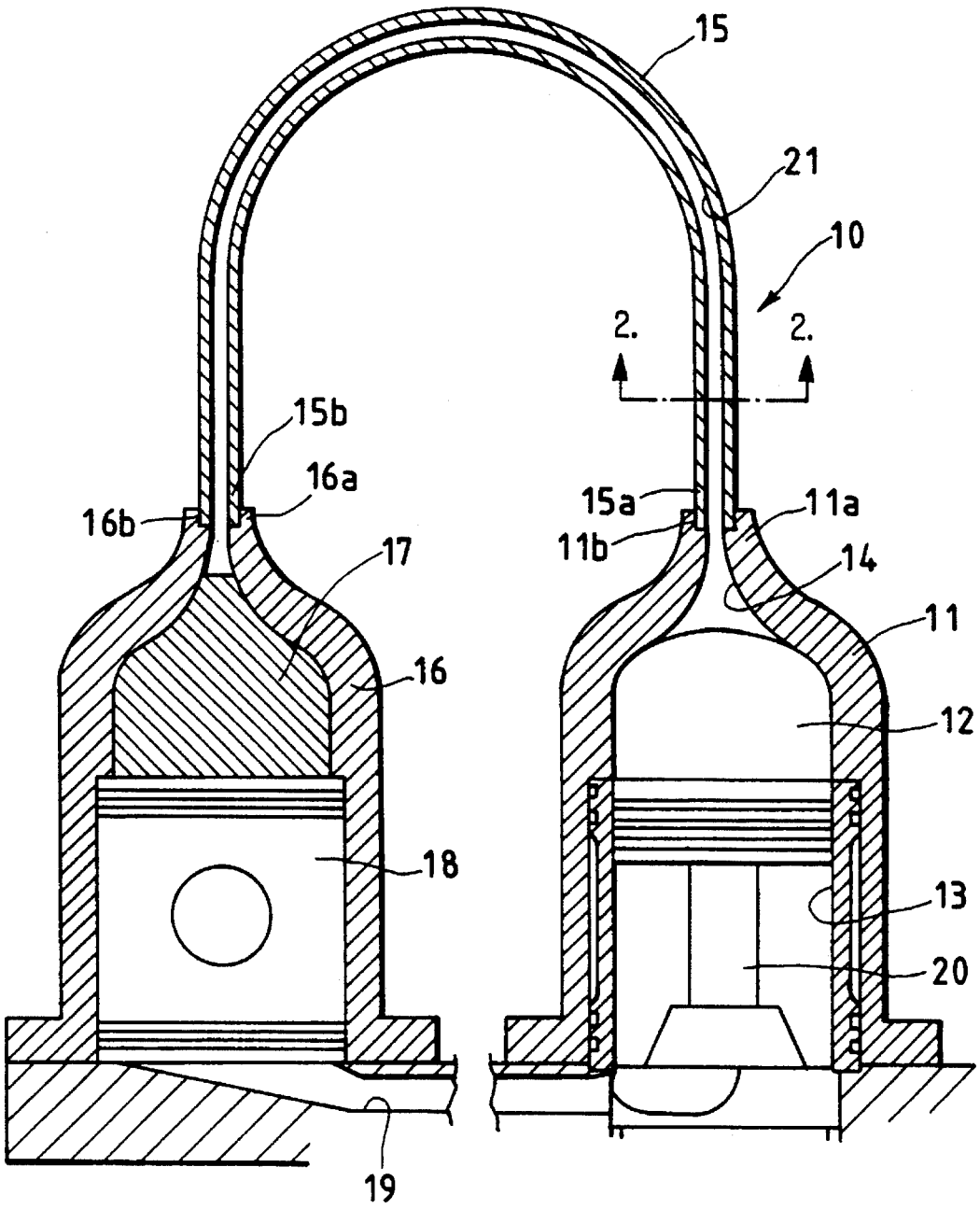
FIG. 1 is a sectional view showing an example of a Stirling engine according to a first embodiment of the invention.

In the Stirling engine, as shown in FIG. 1, a piston 12 is slidably fitted in a piston cylinder 11 made of a pipe, forming a compression space 13 and an expansion space 14 therein. The piston 12 is coupled through a rod 20 to a crank mechanism (not shown). The compression space 13 is communicated with the cooling unit of another cylinder (not shown), when the expansion space 14 is communicated through a heating unit 15 (described later) with a heat accumulating unit 17 accommodated in a cylindrical housing 16 made of a pipe. The heat accumulating unit 17 is communicated with a cooling unit 18 accommodated in the housing 16. The cooling unit 18 is communicated through a communicating path 19 to the compression space (not shown) of a next cylinder. An operating fluid such as for instance helium is sealingly filled in the compression space 13 and the expansion space 14.

Figure 2:
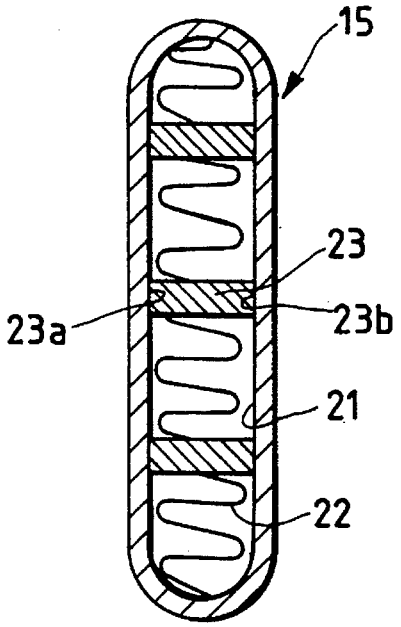
FIG. 2 is an enlarged sectional view taken along line A—A in FIG. 1.
Figure 4:
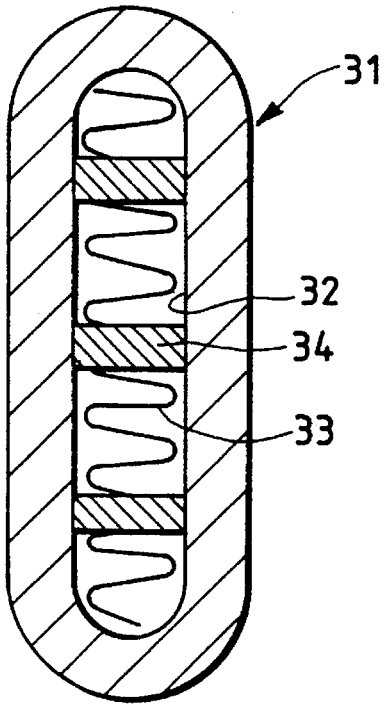
FIG. 4 is an enlarged sectional view taken along line B—B in FIG. 3.

FIG. 2 is an enlarged sectional view taken along line A—A in FIG. 1. As shown in FIGS. 1 and 2, the heating unit 15 is formed by using a single pipe which provides a flow path 21 for the operating fluid. The flow path 21 is extended substantially perpendicular to the surface of the drawing. In the flow path 21, a plurality of heat transferring fins 22 and a plurality of reinforcing members 23 are provided. The heat transferring fins 22 are to increase the heat transfer area of the heating unit 15. The reinforcing members 23 are to prevent the heating unit 15 from expanding when the operating fluid in the heating unit is expanded by external heat. The reinforcing members 23 are laid in the heating unit from end to end. Both edges of each of the reinforcing members 23 are fixedly secured to the inner surfaces of the heating unit 15, for instance, through brazing filler metal.

In the first embodiment, the heating unit 15 is formed as a component separately from the cylinder 11 and the housing 16. One end portion of the heating unit 15, namely, the expansion-space-side end portion 15*a* of the heating unit 15 is fixedly fitted in a flat portion 11a formed at the heating-unit-side end of the cylinder 11, while the other end portion of the heating unit 15, namely, the heat-accumulating-unit-side end portion of the heating unit 15 is also fixedly fitted in a flat portion 16*a* formed at the heating-unit-side end of the housing 16. The flat portion 11*a* of the cylinder 11 has an annular groove 11*b* into which the one end portion 15*a* of the heating unit 15 is inserted. Similarly, the flat portion 16*a* of the housing 16 has an annular groove 16*b* into which the other end portion 15*b* of the heating unit 15 is inserted.

Now, a method of fixing the heating unit 15 to the cylinder 11 will be described concretely.

First, the annular groove 11*b* is formed in the end portion of the cylinder 11, and blazing filler metal is applied to the annular groove 11*b* thus formed. Next, a space (not shown) whose width is substantially equal to the smaller width of the heating unit 15, is inserted into the latter 15. Thereafter, the one end portion 15*a* of the heating unit 15 is inserted into the opening in the end portion of the cylinder 11. Under this condition, the end portion of the cylinder 11 is flattened by pressing. As a result, the outer cylindrical surface of the one end portion 15*a* of the heating unit merges through the blazing filler metal with the annular grooves. Thereafter, the spacer is removed from the heating unit 15.

In the above-described first embodiment, the heating unit 15 is formed by using one pipe. Hence, when compared with the conventional Stirling engine in which the heating unit is formed by using a number of heater tubes, the first embodiment is advantageous in that, in connecting the heating unit 15 to the cylinder 11 and the housing 16, the number of assembling steps is reduced as much.

Furthermore in the first embodiment, the pipe forming the heating unit 15 is the flattened one. Therefore, if it is assumed that the heating unit has the same dead volume as the one which is formed by using a tube circular in section, the former is larger in surface area and accordingly in heat transfer area than the latter, so that the heating unit formed by using the flattened pipe is larger than the one formed by using the tube circular in section in the amount of heat transferred to the inside of the heating unit from outside. When the pipe is further flattened, then the resultant heating unit has substantially the same amount of heat transfer as the conventional one which is formed by using a number of heater tubes circular in section.

The provision of the fins 21 inside the heating unit 15 further increases the heat transfer area, and accordingly the amount of heat transfer.

As was described above, in order to prevent the increase in volume of the flow path in the heating unit 15, the reinforcing members 23 are provided in the latter. That is, the provision of the reinforcing members 23 eliminates the difficulty that, when the operating fluid in the heating unit 15 is expanded by heating, the heating unit 15 is inflated and broken. This contributes to an improvement of the durability of the heating unit 15.

In the embodiment, the heating unit 15 is formed as one part by using a pipe separately from the cylinder 11 and the housing 16. Hence, when compared with the heating unit which is formed integral with the cylinder and the housing, the heating unit 15 of the invention can be reduced in wall thickness.

Furthermore, in the first embodiment, the end portions of the cylinder 11 and the housing 16 are formed into the flat portions 11*a* and 16*a*, respectively, and both end portions 15*a* and 15*b* of the heating unit 15 are fixedly connected to the flat portions 11*a* and 16*b*, respectively. Hence, the heating unit 15 can be welded to the cylinder 11 and the housing 16 with ease.

Figure 3:
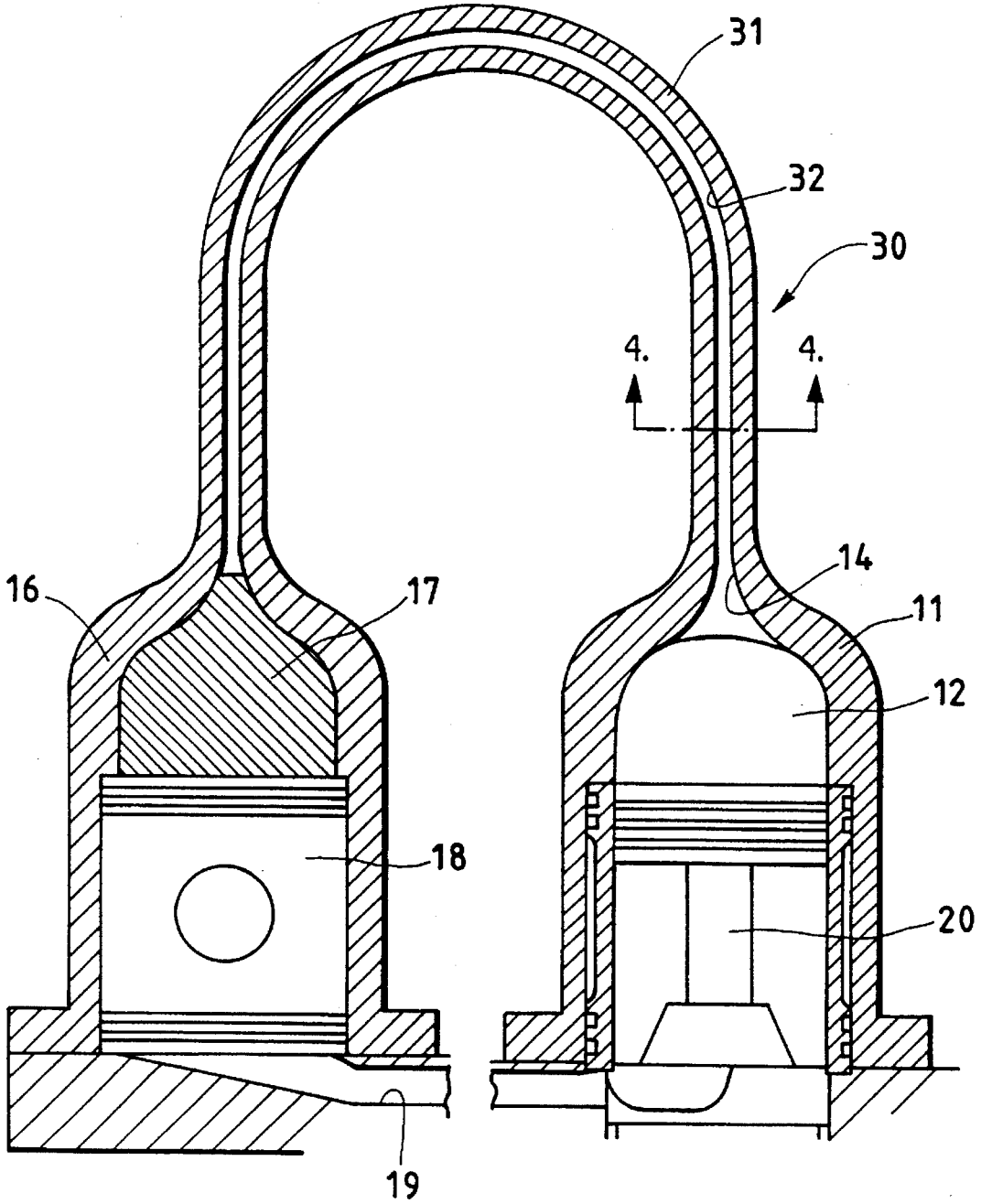
FIG. 3 is a sectional view showing another example of the Stirling engine according to a second embodiment of the invention.

FIG. 3 shows another example of the Stirling engine, which constitutes a second embodiment of the invention.

The Stirling engine 30 shown in FIG. 3 is fundamentally equal in arrangement to the one 10 shown in FIG. 1, the first embodiment; however, the former 30 is different from the latter 10 in that the heating unit 31, the cylinder 11, and the housing 16 are formed as one complete unit by using one and the same pipe. Hence, in the second embodiment, the heating unit 31, being integral with the cylinder 11 and the housing 16, is larger in wall thickness than the heating unit 15 in the first embodiment. Similarly as in the case of the first embodiment, the heating unit 31 has a flow path 32 for the operating fluid in which heat transferring fins 33 and reinforcing members 34 are provided.

In the second embodiment, as was described above, the heating unit 31 is formed integral with the cylinder 11 and the housing 16. The second embodiment is free from the problem that the heating unit 31 is not sealingly connected to the cylinder 11 and the housing 16, and from the assembling work of connecting the heating unit 31 to the cylinder 11 and the housing 16.

The first and second embodiments of the invention have been described with reference to the double acting type Stirling engine; however, the invention is not limited thereto or thereby. That is, the technical concept of the invention may be applied, for instance, to a two-piston type engine and a displacer type engine.

The Stirling engine according to the invention has the following effects or merits:

In the Stirling engine of the invention, the heating unit is formed by using one pipe. Hence, the Stirling engine, when compared with the conventional one whose heating unit is formed by using a number of heater tubes, is advantageous in that, in connecting the heating unit to the cylinder having the expansion space and the housing accommodating the heat accumulating unit, the number of assembling steps is small.

In addition, the pipe forming the heating unit is the flatted one. Hence, under the condition that the flattened pipe is equal in dead volume to the heater tube circular in section, the flattened pipe is larger in surface area and accordingly in heat transfer area than the heater tube circular in section, so that the heating unit formed by using the flattened pipe is larger than the heating unit formed by using the heater tube circular in section in the amount of heat transferred to the inside of the heating unit from outside. When the pipe is further flattened, then the resultant heating unit may have substantially the same amount of heat transfer as the conventional one which is formed by using a number of heater tubes circular in section.

Further, in the Stirling engine of the invention, the provision of the heat transferring fins inside the heating unit further increases the heat transfer area, with the result that the amount of heat transfer is increased.

Still further, in the Stirling engine of the invention, in order to prevent the increase in volume of the flow path in the heating unit, the reinforcing members are provided in it. That is, the reinforcing members thus provided eliminate the difficulty that, when the operating fluid in the heating unit is expanded by heating, the heating unit is inflated and broken. This contributes to an improvement of the durability of the heating unit.

Still further, in the Stirling engine of the invention, the heating unit is formed integral with the cylinder. Hence, the Stirling engine is free from the problem that the heating unit is not sealingly connected to the cylinder, and from the assembling work of connecting the heating unit to the cylinder.

Still further, in the Stirling engine of the invention, the expansion-space-side end portion of said cylinder is formed into the flat portion, and the expansion-space-side end portion of the heating unit is fixedly secured to the cylinder being held by the flat portion. Hence, in the Stirling engine, the heating unit may be smaller in wall thickness and accordingly larger in the amount of heat transfer than the one which is integral with the cylinder.

Still further, in the Stirling engine of the invention, the heating unit is formed integral with the housing. Hence, the Stirling engine is free from the problem that the heating unit is not sealingly connected to the housing, and from the assembling work of connecting the heating unit to the housing.

Still further, in the Stirling engine of the invention, the heating-unit-side end portion of the housing is formed into the flat portion, and the heat-accumulating-unit-side end portion of the heating unit is fixedly secured to the housing being held by the flat portion. Hence, in the Stirling engine, the heating unit may be smaller in wall thickness and accordingly larger in the amount of heat transfer than the one which is integral with the cylinder.

While there has been described in connection with the preferred embodiments of this invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A Stirling engine comprising:

a cylinder having an expansion space;

a heat accumulating unit;

a housing accommodating said heat accumulating unit; and a single heating unit through which said expansion space is communicated with said heat accumulating unit, said heating unit being formed of a flattened pipe.

2. A Stirling engine as claimed in claim 1, further comprising heat transferring fins provided in said heating unit.

3. A Stirling engine as claimed in claim 1, further comprising reinforcing members provided in said heating unit to prevent the flow path in said heating unit from increasing in volume.

4. A Stirling engine as claimed in claim 1, wherein said heating unit is integral with said cylinder.

5. A Stirling engine as claimed in claim 1, wherein one end portion of said cylinder on the side of said expansion space is formed into a flat portion, and one end portion of said heating unit on the side of said expansion space is fixedly secured to said cylinder being held by said flat portion of said cylinder.

6. A Stirling engine as claimed in claim 1, wherein said heating unit is integral with said housing.

7. A Stirling engine as claimed in claim 4, wherein said heating unit is integral with said housing.

8. A Stirling engine as claimed in claim 1, wherein one end portion of said housing on the side of said heating unit is formed into a flat portion, and the other end portion of said heating unit on the side of said heal accumulating unit is fixedly secured to said housing being held by said flat portion of said housing.

9. A Stirling engine as claimed in claim 5, wherein one end portion of said housing on the side of said heating unit is formed into a flat portion, and the other end portion of said heating unit on the side of said heat accumulating unit is fixedly secured to said housing being held by said flat portion of said housing.

* * * * *